US005645175A

United States Patent [19]

Wood

[11] Patent Number: 5,645,175

[45] Date of Patent: Jul. 8, 1997

[54] INFORMATION TAG FOR BUTTERFLY HOOK

[76] Inventor: James Michael Wood, 5125 Partridge Rd., Fort Worth, Tex. 76132

[21] Appl. No.: 678,303

[22] Filed: Jul. 11, 1996

[51] Int. Cl.[6] ..... B42F 1/00; G09F 3/00

[52] U.S. Cl. ..... 211/57.1; 211/59.1; 248/220.41

[58] Field of Search ..... 211/57.1, 59.1, 211/106; 248/220.21, 220.31, 220.41, 220.42; 40/642

[56] References Cited

U.S. PATENT DOCUMENTS

| | | | |
|---|---|---|---|
| 1,033,915 | 7/1912 | McDonald | 211/57.1 X |
| 1,109,035 | 9/1914 | Buie | 211/57.1 X |
| 1,709,041 | 4/1929 | Schutt | 40/642 X |
| 1,848,950 | 3/1932 | Hammes | 40/642 |
| 3,200,960 | 8/1965 | Banse | 211/59 |
| 3,481,482 | 12/1969 | Wilkens | 248/220.41 |
| 4,246,710 | 1/1981 | Mixer | 211/57.1 X |
| 4,351,440 | 9/1982 | Thalenfeld | 211/57.1 |
| 4,405,051 | 9/1983 | Thalenfeld | 211/57.1 |
| 4,520,978 | 6/1985 | Taub | 248/220.41 |
| 4,540,093 | 9/1985 | Merl et al. | 211/59.1 |
| 4,750,698 | 6/1988 | Barnes | 248/220.31 X |
| 4,761,904 | 8/1988 | Fast et al. | 40/642 X |
| 4,783,033 | 11/1988 | Valiulis | 248/220.31 X |
| 4,805,861 | 2/1989 | Thalenfeld et al. | 40/642 X |
| 4,821,437 | 4/1989 | Abramson et al. | 40/642 |
| 4,850,557 | 7/1989 | Valiulis | 211/57.1 X |
| 4,869,376 | 9/1989 | Valiulis et al. | 248/220.41 X |
| 5,054,220 | 10/1991 | Touzalin et al. | 40/642 |
| 5,088,606 | 2/1992 | Boas | 211/57.1 |
| 5,236,163 | 8/1993 | Valiulis | 211/57.1 X |
| 5,348,167 | 9/1994 | Jensen | 211/59.1 X |
| 5,439,120 | 8/1995 | Brozak | 211/59.1 |
| 5,441,161 | 8/1995 | Merl | 211/59.1 X |
| 5,442,872 | 8/1995 | Moser | 40/642 |
| 5,485,930 | 1/1996 | Rushing | 211/59.1 |
| 5,531,417 | 7/1996 | Valiulis et al. | 211/59.1 X |

OTHER PUBLICATIONS

Catalog of hooks, *Southeastern Manufacturing Co., Inc.*, May 1, 1994.

Sales information on scanner code hooks, *Polyman Plastics Co.*, No Date.

*Primary Examiner*—Leslie A. Braun
*Assistant Examiner*—Sandra Snapp
*Attorney, Agent, or Firm*—Geoffrey A. Mantooth

[57] ABSTRACT

A tag is provided for a butterfly hook. The hook has a cross-piece located at its free end. The tag has a plate and a hinge. The hinge is removably coupled to the cross-piece by a snap fit. The tag can pivot between a normal position, wherein the tag hangs down, and an up position wherein the tag is held projecting upwardly. The plate has merchandise information on both of its sides. The information relates to the merchandise hanging from the hook. In the normal position, a front side of the tag is displayed to a customer or to store personnel. In the up position, the rear side of the tag is displayed. Merchandise can be placed onto and removed from the hook free of interference by the tag because the tag is able to swing to a position that is generally parallel to the hook and because the tag has a low profile relative to the wire used in the hook.

9 Claims, 2 Drawing Sheets

INFORMATION TAG FOR BUTTERFLY HOOK

FIELD OF THE INVENTION

The present invention relates to hooks that are used to display merchandise in a retail environment.

BACKGROUND OF THE INVENTION

A common way to display merchandise in a retail store is to hang the merchandise from a vertical wall. Much merchandise comes packaged in such a way so as to allow it to be hung from hooks mounted in a peg board or a slotted wall.

The hooks protrude from the wall. A common type of hook utilizes a single piece of heavy wire that protrudes out (generally horizontally) from the wall. The merchandise is hung from this piece of wire.

An improvement to this single hook is a scanner hook. A scanner hook has a second piece of heavy duty wire that extends parallel to and above the first piece of wire. At the end of the second piece of wire is a plate for receiving a label beating information on pricing and product identification. The plate also provides some protection against puncture wounds that can be caused by the end of the first piece of wire.

Others in the prior art have modified the hook in order to provide for a tag that is capable of beating pricing and product information. For example, in Boas, U.S. Pat. No. 5,088,606, the hook has been redesigned in order to accommodate the tag. Such hooks are costly to produce and complicated to use.

The retail industry prefers to use a type of hook known as a butterfly hook (so named because the slot formed in the merchandise resembles a cross-section of a butterfly) or a double loop hook. A butterfly hook has two parallel wires extending out from the vertical wall. The two wires are in the same generally horizontal plane. The ends of the wires are joined together with a cross piece, thereby reducing the risk of injury to shoppers. Such a hook is shown in Banse U.S. Pat. No. 3,200,960.

It is desirable to provide information on pricing and product identification on such a butterfly hook.

SUMMARY OF THE INVENTION

It is an object of the present invention to provide an information tag for a butterfly hook.

The present invention provides an apparatus for use in displaying merchandise. The apparatus has a hook that has two spaced apart lateral portions. Each lateral portion has a first end and a second end. The first ends of the lateral portions are coupled together by a cross-piece. The second end of each lateral portion is structured and arranged to be coupled to a wall. The apparatus also has a tag that includes a plate. The plate has first and second surfaces that are structured and arranged to receive printed information thereon. The tag includes a hinge that is coupled to the plate. The hinge includes a knuckle that is curved around a cylindrical bore toward one of the first or second surfaces of the plate. The knuckle has an end. The end of the knuckle is separated from the one of the first or second surfaces of the plate by a gap. The tag is removably coupled to the hook with the cross-piece being received in the cylindrical bore of the hinge. The tag can swing between first and second positions. In the first position, the tag depends from the cross-piece so as to display the first surface of the plate to a point of view that is located on a side of the cross-piece that is opposite from the second end of the hook lateral portions (the first surface would thus be displayed to a customer). The second end of the hook lateral portion is to be coupled to a wall. In the second position, the tag is elevated above the cross-piece so as to display the second surface of the plate to a point of view that is located on the side of the cross-piece opposite from the second ends of the hook lateral portions.

In accordance with one aspect of the invention, the hook is made of a single piece of wire. The apparatus uses a conventional wire butterfly hook. These types of hooks are economical to manufacture. The tag is suitable for use with the butterfly hook. No modification to the butterfly hook is needed, thereby providing an apparatus that is economical to manufacture.

The tag is thin so as to provide a low profile. This allows merchandise to be slipped onto and removed from the hook without any interference from the tag.

The tag has a snap on hinge that allows the tag to be removed from the hook. Thus the hook can be used without a tag. Alternatively, the tag on a hook can be replaced with a new tag.

The tag normally hangs down from the end of the hook, where its front side is displayed. The tag can be swung to an up position, wherein its rear side is displayed. This allows information to be put on the rear side. Because both sides of the tag are used, the tag can be made smaller than conventional tags and still provide easy to read pricing and product information.

The tag is provided with shoulders that make the tag self-supporting when the tag is in the up position. Thus, store personnel need not hold the tag in the up position to view its rear side.

DESCRIPTION OF THE PREFERRED EMBODIMENT

The present invention provides a tag 11 for a butterfly hook 13. The tag 11 is snapped onto the outer most end of the hook 13. A label 15 is placed onto front and rear sides of the tag.

Figure 1:
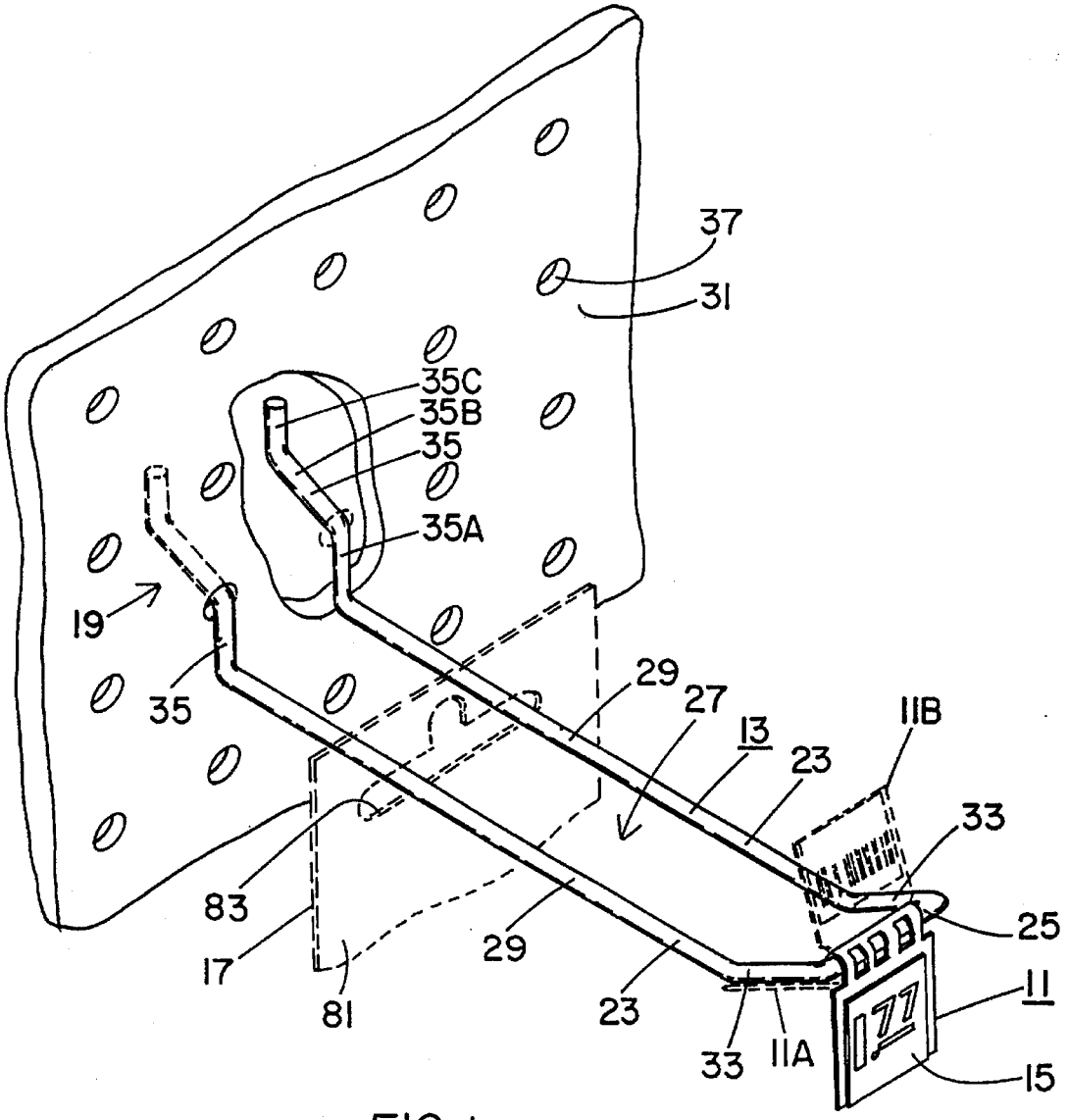
FIG. 1 is an isometric view of a butterfly hook equipped with a tag of the present invention, in accordance with a preferred embodiment. The hook is mounted in a peg board wall, a portion of which is shown cut away.

As shown in FIG. 1, the tag 11 normally hangs down, displaying product information and pricing information to customers. Merchandise 17 can be easily removed from the hook; the tag 11 swings forward and up to align with the end of the hook. Merchandise can also be easily placed onto the hook; the tag swings back and against the end of the hook (in this position the tag is shown by dashed lines and is designated as 11A). Thus, the tag presents a low profile so as not to interfere with the installation and removal of merchandise from the hook.

During inventory, the tag 11 can be flipped forward and up (in this up position, the tag is shown by dashed lines and is designated as 11B). In this up position of the tag its rear side is displayed so as to display inventory information. For example, a bar code can be located on the rear side of the tag. Once the tag is in the up position, the tag remains in this position, thereby allowing the operator to scan the bar code without the necessity of holding the tag up. This effectively frees one of the operator's hands.

The tag 11 is removable from the hook 13. Thus, the tag can be snapped off of the hook, and a new tag, bearing new product or pricing information, can be snapped onto the hook. The information can be imprinted directly on the tag or provided in the form of a paper label that adheres to the surfaces of the tag.

Referring to FIG. 1, the specifics of the invention will now be described. The hook 13 is conventional and commercially available. The hook 13 is known as a butterfly or double loop hook. The hook 13 is made up of a single piece of wire. The wire gauge and overall size of the hook vary depending on the weight of the merchandise 17 which is to be displayed. The hook 13 has a back end 19 and a front end 21. This back end 19 couples to a wall 31. The front end 21 extends out from the wall toward an aisle or other shopping area.

The hook 13 is made up of three portions. There are two lateral portions 23 and a cross piece 25. The two lateral portions 23 are substantially similar to each other and are separated from each other by a gap 27. Each lateral portion 23 has an intermediate section 29 that is generally horizontal when the hook 13 is installed onto the wall 31. Each lateral portion 23 also has a front section 33 that extends up at about 30 degrees from the horizontal. The two sloped front sections 33 are joined together by the cross-piece 25. The rear section 35 of each lateral portion 23 extends vertically upwards 35A from the intermediate section 29, then slopes rearwardly 35B at an angle to the horizontal, then extends vertically upward 35C again. The rear section 35 of each lateral portion 23 thus forms a zigzag pattern. The rear sections are received by holes 37 in the peg board wall 31. The hook 13 can also be placed in a slot wall (not shown).

The tag is shown in more clearly in FIGS. 2–5. The tag has a plate 41 and a hinge 43.

Figure 2:
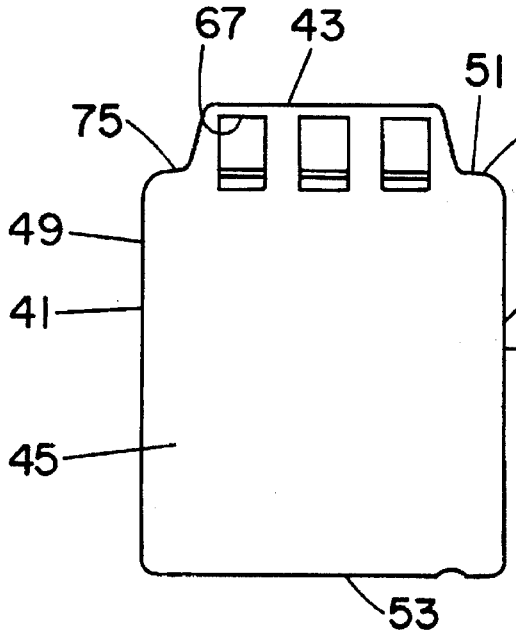
FIG. 2 is a front view of the tag.
Figure 3:
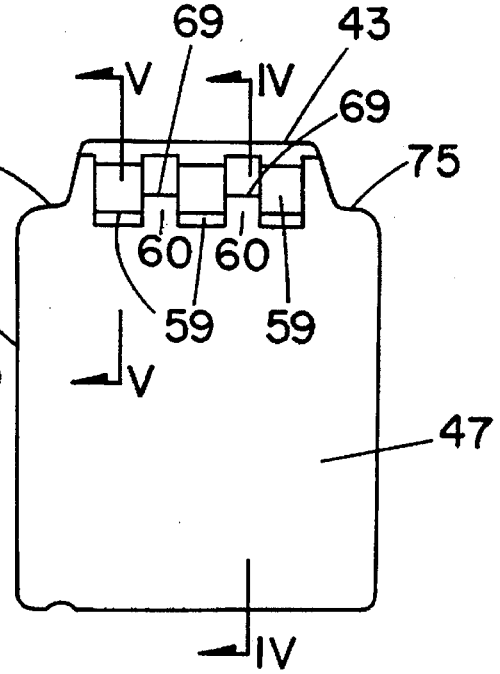
FIG. 3 is a rear view of the tag.
Figure 4:
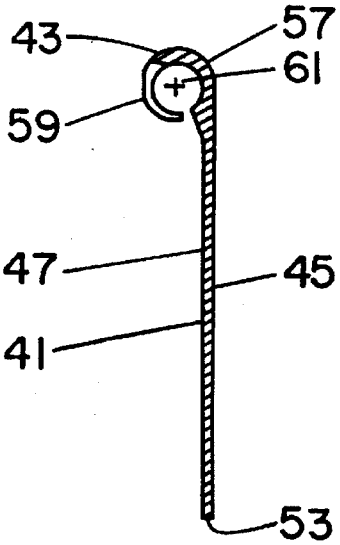
FIG. 4 is a cross-sectional view of the tag taken through lines IV—IV of FIG. 3.
Figure 5:
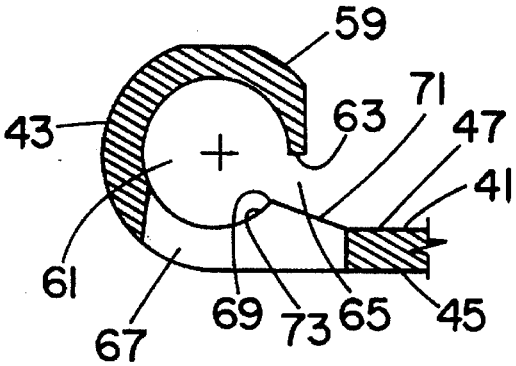
FIG. 5 is a cross-sectional detailed view of the hinge taken through lines V—V of FIG. 3.

The plate 41 has a front surface 45 and a rear surface 47 (see FIGS. 2 and 3). The plate 41 is generally rectangular in shape, with rounded corners. The plate has side edges 49, a top edge 51, and bottom edge 53. The width of the plate between the side edges 49 is substantially the same as the overall width of the hook 13 (the overall width of the hook being the gap 27 between lateral portions 23 and the diameters of the lateral portions themselves). By making the width of the tag the same as or smaller than the hook, the tag will not interfere with the installation or removal of merchandise 17 on and off of the hook. The length of the plate between the top and bottom edges 51, 53 is preferably about the same as the length of the front section 33 of the hook. Thus, when the tag is swept hack during placement of merchandise onto the hook, the bottom edge of the tag does not interfere with locating the merchandise on the hook. The thickness of the plate 41 (see FIG. 4) is less than the diameter of the wire of the hook 13. This provides a low profile tag that does not interfere with the placement and removal of merchandise of the hook. In the preferred embodiment, the thickness of the plate is less than one half of the wire diameter.

The hinge 43 extends from the top edge 51 of the plate 41 and curves over toward the rear surface 47 of the plate. The hinge 43 has a wall 57 that curves 90 degrees from the plate (see FIGS. 4 and 5). The hinge also has knuckles 59 (see FIG. 5) that extend from the wall 57 and curve toward the rear surface 47 of the plate. The knuckles 59 are separated from each other by gaps 60. The wall 57 and the knuckles 59 form a cylindrical bore 61 that receives the cross-piece 25 of the hook (see FIG. 1). The ends 63 of each of the knuckles 59 are separated from the plate 41 by a gap 65. Thus, the tag 11 can be removably coupled to the hook cross-piece 25 by passing the cross-piece through the gap 65 and into the cylindrical bore 61. The gap 65 is smaller than a diameter of the cross-piece 25. The knuckles 59 are flexible so as to allow the gap 65 to enlarge during installation and removal of the tag on the hook. Once the tag is installed onto the cross-piece 25, the tag can be removed only by exertion of sufficient force to flex the knuckles 59 and open the gap 65.

Openings 67 are provided in the hinge wall 57 directly opposite of the knuckles. The openings 67 enable the tag to be molded more easily. A notch is formed in the bottom edge 53. This notch is also useful in the molding process.

The retention of the cross-piece 25 in the cylindrical bore 61 is enhanced by providing one or more projections 69 on the plate side of the gap 65. Each projection 69 has an inclined surface 71 that is used to guide the hook 13 into the hinge 43. Each projection 69 also has an arcuate surface 73 that forms part of the wall of the cylindrical bore 61.

The hinge 43 is offset from the side edges 49 of the plate 41 (see FIGS. 2 and 3). This forms shoulders 75 on each side of the hinge 43. The shoulders are formed by the top edge 51 of the plate 41. The shoulders 75 are used to support the tag 11 in the up position.

The use of the tag 11 and hook 13 will now be described. The hook 13 is mounted to the wall 31 in accordance with conventional practice. If the wall is peg board, the rear section 35 of each lateral portion is inserted into appropriate openings 37 in the wall 31.

A label 15 is mounted to the tag 11. The label is placed on the front surface 45 of the plate 41, around the bottom edge 53 and on the rear surface 47 of the plate. Thus, only a single label need be used to cover both surfaces of the plate. The label is provided with an adhesive. Information can be printed on the label. Typically, pricing and product information will appear on the front side of the plate, while a bar code will appear on the rear side. Because the tag 11 can be flipped to display both sides, the tag can be smaller than conventional tags. Conventional tags must provide all information on just one side and consequently must be bigger in area.

The label can be put on the tag before or after installing the tag onto the hook.

To install the tag 11 onto the hook 13, the hinge 43 is mounted on the cross-piece 25 by forcing the cross-piece into the cylindrical bore 61 of the hinge 43. Once the tag is installed on the hook, the tag is able to swing between various positions. In its normal position, the tag hangs down from the hook as shown in solid lines in FIG. 1. With the tag in this normal position, product and pricing information is displayed to a customer.

Merchandise 17 is easily loaded onto the hook 13. The merchandise 17 has a card 81 with a butterfly slot 83 therein. The card 81 is placed onto the hook 13 by pushing the slot onto the hook in accordance with conventional practice. The tag 11A swings back to contact the front section 33 of the hook, thereby allowing the merchandise to be easily loaded onto the hook. Because the tag is thin relative to the hook, the tag does not interfere with the loading of merchandise onto the hook. After the merchandise is pushed clear of the tag, the tag swings free of the merchandise in a forward direction to its normal position shown in FIG. 1.

To remove merchandise from the hook, the merchandise is grabbed and pulled off of the hook. As the merchandise is pulled off, the tag is pushed forward by the merchandise card 81 so as to extend in generally the same plane as the front section 33 of the hook 13. Once the merchandise is removed from the hook and the tag, the tag is free to swing back to its normal position.

During inventory, store personnel can flip the tag 11B to its up position as shown in dashed lines in FIG. 1. Further rotation of the tag is stopped by the shoulders 75 contacting the hook 13. The tag is thus positioned in a near vertical orientation (the tag slopes slightly towards the wall in order to maintain the tag in the up position). The tag is capable of holding itself in the up position. The store personnel scans the bar code on the rear surface 47 of the tag. When finished scanning, the store personnel flips the tag forward and the tag resumes its normal position.

New pricing or product information can be provided on the tag in several ways. A new label can be placed over the old label 15. Alternatively, the tag can be removed from the hook and replaced with a new tag bearing a new label.

The tag 11 is removed from the hook by pushing the tag up when the tag is in the normal position. This causes the knuckles to flex, and allows the hook cross-piece 25 to exit the hinge.

Although the tag has been described as bearing a label, the information can be printed directly onto the plate of the tag itself.

In the preferred embodiment, the tag is made of plastic. The hook is made of metal wire.

The foregoing disclosure and the showings made in the drawings are merely illustrative of the principles of this invention and are not to be interpreted in a limiting sense.

I claim:

1. An apparatus for use in displaying merchandise, comprising:

a) a hook having two spaced apart lateral portions, each lateral portion having a first end and a second end, the first ends of the lateral portions being coupled together by a cross-piece, the second end of each lateral portion being structured and arranged to coupled to a wall, the lateral portions being structured and arranged to receive the merchandise;

b) a tag comprising a plate, the plate having first and second surfaces that are structured and arranged to receive printed information thereon, the plate having first and second ends;

c) the tag further comprising a hinge coupled to the plate first end, the hinge comprising a knuckle that is curved around a bore toward one of the first or second surfaces of the plate, the knuckle having an end, the end of the knuckle being separated from the one of the first or second surfaces of the plate by a gap;

d) the tag being removably coupled to the hook with the cross-piece being received in the bore of the hinge, with the tag being capable of swinging between a first position, a second position, and a third position wherein in the first position, the tag depends from the cross-piece so as to display the first surface of the plate to a point of view that is located on a side of the cross-piece opposite from the second end of the hook lateral portions and in the second position, the tag is elevated above the cross-piece so as to display the second surface of the plate to a point of view that is located on the side of the cross-piece opposite from the second ends of the hook lateral portions, and in the third position, the tag is parallel to the first end of the hook so as to allow the merchandise to be placed onto the hook with the tag in place on the hook.

2. The apparatus of claim 1 wherein the hook is made of wire.

3. The apparatus of claim 2 wherein the hook is made of a single piece of wire.

4. The apparatus of claim 2 wherein the wire has a thickness and the plate has a thickness, the plate thickness being less than the wire thickness.

5. The apparatus of claim 4 wherein the plate has a thickness that is one half or less of the wire thickness.

6. The apparatus of claim 1 wherein:

a) the plate has side edges, with the hinge being located between the side edges;

b) the plate has shoulders between the side edges and the hinge, the shoulders bearing on the hook when the tag is in the second position so as to make the tag stand upright in the second position.

7. The apparatus of claim 1 further comprising a label located on the plate first and second surfaces and around an edge of the plate.

8. The apparatus of claim 1 wherein:

a) the hook is made of wire;

b) the wire has a thickness and the plate has a thickness, the plate thickness being less than the wire thickness;

c) the plate has side edges, with the hinge being located between the side edges;

d) the plate has shoulders between the side edges and the hinge, the shoulders bearing on the hook when the tag is in the second position so as to make the tag stand upright in the second position;

e) a label located on the plate first and second surfaces and around an edge of the plate.

9. The apparatus of claim 1 wherein the hook is a butterfly hook.

* * * * *